United States Patent [19]

de Bruyne

[11] Patent Number: 4,465,377

[45] Date of Patent: Aug. 14, 1984

[54] MAGNETIC STIRRER APPARATUS WITH GUIDED, FLOATING STIRRER

[75] Inventor: Norman A. de Bruyne, Princeton, N.J.

[73] Assignee: Techne Corporation, Princeton, N.J.

[21] Appl. No.: 502,619

[22] Filed: Jun. 7, 1983

[51] Int. Cl.[3] ..... B01F 13/08

[52] U.S. Cl. ..... 366/273; 366/280; 366/286

[58] Field of Search ..... 366/241, 242, 243, 244, 366/245, 246, 247, 248, 249, 250, 251, 255, 256, 273, 274, 279, 280, 285, 286; 422/224; 435/316

[56] References Cited

U.S. PATENT DOCUMENTS

| | | | |
|---|---|---|---|
| 1,242,493 | 10/1917 | Stringham . | |
| 1,420,773 | 6/1922 | Stainbrook . | |
| 1,984,975 | 12/1934 | Lodder . | |
| 2,773,747 | 12/1956 | King et al. . | |
| 2,958,517 | 11/1960 | Harker et al. . | |
| 3,439,899 | 4/1969 | Hershler . | |
| 3,572,651 | 3/1971 | Harker . | |
| 3,622,129 | 11/1971 | Mazowski . | |
| 3,649,465 | 3/1972 | Scharf et al. . | |
| 3,985,649 | 10/1976 | Eddelman | 366/273 |
| 4,310,253 | 1/1982 | Sada et al. . | |
| 4,393,810 | 7/1983 | Kasper | 366/273 |

*Primary Examiner*—Robert W. Jenkins
*Assistant Examiner*—Arthur D. Dahlberg
*Attorney, Agent, or Firm*—Irvin A. Lavine

[57] ABSTRACT

A magnetic stirrer apparatus includes a vessel for liquid and a floating stirrer. The floating stirrer is rotated by a magnet driven by a magnetic field generator laterally of the vessel, and a guide rod through the floating stirrer restricts its movement to rotary movement and substantially vertical movement with change in the liquid level. The magnetic field generator is operative at any level of the liquid in the vessel.

29 Claims, 16 Drawing Figures

Fig-9
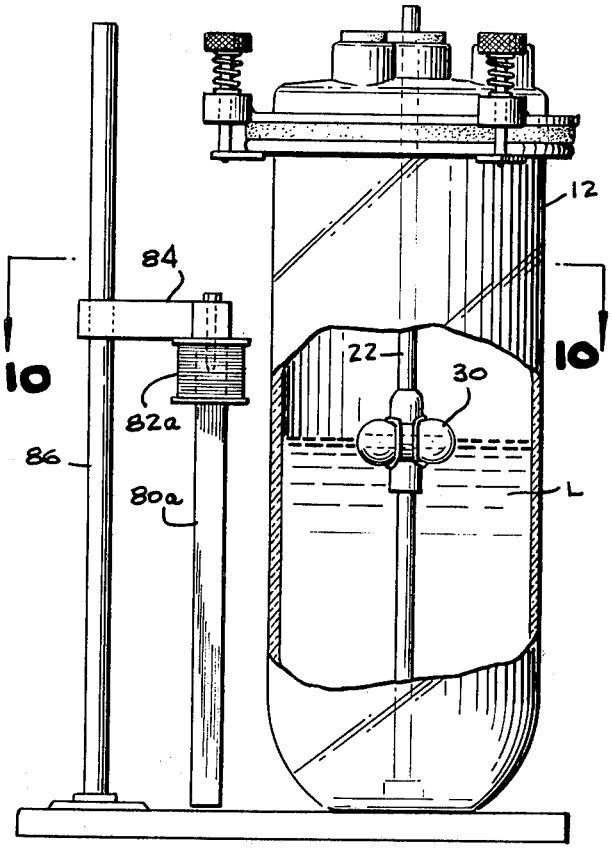
Fig-6
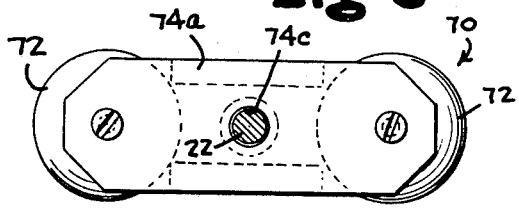
Fig-7
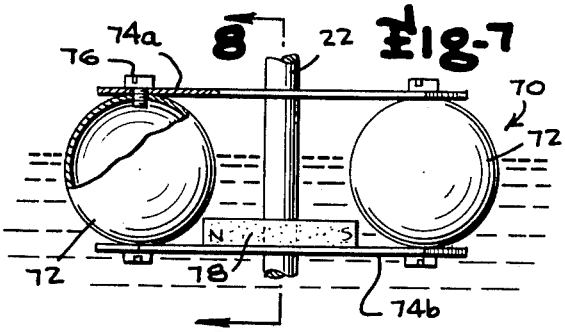
Fig-8
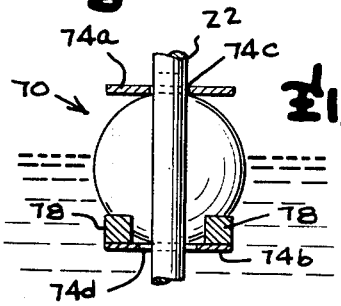
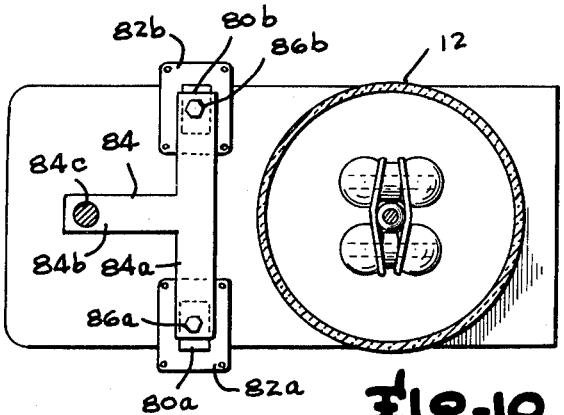
Fig-10
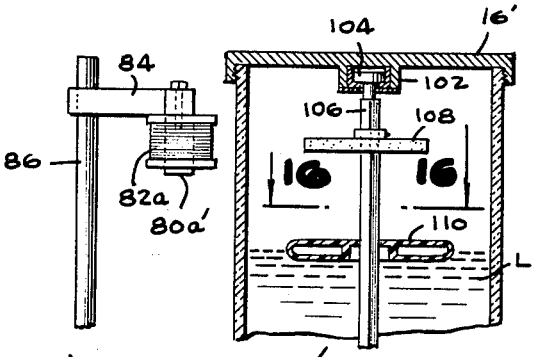
Fig-15
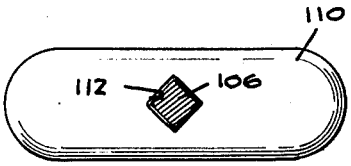
Fig-16

MAGNETIC STIRRER APPARATUS WITH GUIDED, FLOATING STIRRER

TECHNICAL FIELD

The present invention relates to a magnetically driven stirrer apparatus, wherein the stirrer is buoyant.

BACKGROUND ART

Apparatus for stirring liquid materials, including culture mediums, have long been known. For example, Scharf et al. U.S. Pat. No. 3,649,465 provides a flask or vessel having an opening at its upper portion, with a closure for the opening, having a spindle extending therethrough, the spindle at its lower end having a magnetic stirrer, with a shroud extending in surrounding relationship to the spindle. The stirrer is driven magnetically by a driving magnet, and the magnetic stirrer, located at the bottom of the flask, may be adjusted through a limited vertical range by vertically adjusting the spindle within the limits permitted by the shroud.

Harker et al. U.S. Pat. No. 2,958,517 provides a flask having a rod guided in a bearing in a closure for the flask, the rod having at its lower end a magnetic impeller, which engages the bottom of the flask, the magnetic impeller being driven by a magnetic stirring apparatus on which the flask is held, the apparatus including an electric motor having a shaft driving a magnet which is magnetically coupled to the magnet within the flask.

Harker U.S. Pat. No. 3,572,651 provides a flask having a closure provided with a bearing on its underside, the bearing supporting a spindle having at its lower end, near the bottom of the flask, a magnetic stirrer, the magnetic stirrer being driven by a conventional magnetic driving apparatus.

Mazowski U.S. Pat. No. 3,622,129 also discloses a magnetic stirrer apparatus, in which a flask has an opening, a closure for the opening with a rod extending through the opening, the rod supporting at its lower end a magnetic stirrer, and the rod being adjustable, vertically, in the closure, so as to position the stirrer at different depths in the liquid in the flask.

Sada et al. U.S. Pat. No. 4,310,253 discloses an apparatus in which a vessel containing a body of liquid has floating, magnetic particles which are caused to rotate by a rotating magnetic field, to rotate the interface between, for example, a liquid and a gaseous body in the vessel.

There have been provided stirrer apparatus, particularly for cell culture stirring, in which a linearly extending buoyant stirrer was provided, having magnetic means associated with it, so that the stirrer could be rotated by a rotating magnetic field. Such apparatus, while having many advantages, presented a problem of vertical instability when the liquid level was low. Additionally, the stirrer could wander in the flask or vessel when stirring is interrupted for sampling, or by loss of synchronization with the driving magnetic field.

There are also known in the prior art various magnetic stirrer apparatus constructions in which magnetic field generating elements, such as coils, were positioned laterally of a vessel, to drive a rotor located within, specifically at the bottom, of the vessel: in Stringham U.S. Pat. No. 1,242,493, the rotor was, itself, the stirrer element, while in Stainbrook U.S. Pat. No. 1,420,773, the rotor was connected to a shaft which caused rotation of a stirrer element, generally in the form of a propeller.

The prior art in which the stirrer is submerged in the liquid was subject to various defects and deficiencies, including constructions which were difficult to clean and which did not have sufficient cell proliferating action. In some cases, obstructions were provided to the liquid motion by the stirrers, or stirring action unsuitably vigorous for cell culture was required to insure complete stirring action. Those constructions in which a stirrer is submerged, also provide difficulty in that the stirring action is non-uniform with various amounts of liquid in the vessel, and are therefore unsuitable where a culture medium stirring or agitating is to be provided.

Culture medium provides for the growth of cells, from nutrients contained in the medium. The stirring action required is not violent, but is gentle, and care must be taken to avoid damage to cells, such as by violent agitation, and by crushing.

DISCLOSURE OF INVENTION

The present invention is directed to a magnetic stirrer apparatus in which a floating stirrer is provided, with a magnet associated with the floating stirrer, the magnet being rotated by a moving magnetic field. The moving magnetic field is generated by a magnetic field generating apparatus which is laterally of the vessel. The magnet may be connected to and supported by the stirrer, so as to move, generally vertical, with the floating stirrer, with any change in volume, and therefore of the liquid level in the flask or vessel. The field generating means located laterally of the vessel is able to generate a moving magnetic field which will drive the magnet in any position thereof, as its position changes vertically with the changes in liquid level. A guide rod is provided in the vessel, preferably extending downwardly along the vessel axis from the cover, the guide rod extending through an opening in the floating stirrer, so as to guide the floating stirrer, and restrict its movement to rotational movement, upon rotation thereof by the magnet within the vessel, and to generally vertical movement by changes in the liquid level.

The magnetic field generator, in one embodiment, includes a rotating shaft extending beside, and generally parallel to the axis of the vessel; on the shaft at spaced axial locations are a plurality of bar magnets, the ends of the bar magnets orbiting about the axis of the shaft as it is rotated, so as to bring the north and south poles of each magnet successively adjacent to the vessel, and thereby closer to the magnet located within the vessel. In another embodiment, a pair of cores extend in spaced relationship, substantially parallel to the axis of the vessel, and on each core is a coil; the coils are connected to sources of alternating current, so their fields are caused to fluctuate alternately, in known manner. In yet another embodiment, a plurality of coils are arranged about the vessel, supported by an annulus: the supporting annulus may be vertically adjusted, as by being carried by a standard, with a releasable connection beteen the standard and the supporting annulus, to thereby permit the coils and the supporting annulus to be adjusted along the vessel.

In yet another embodiment, the guide rod not only guides the floating stirrer, restricting its movement to rotational movement and movement along the axis with changes in liquid level, but the guide rod is also rotatable, being supported by a bearing on the underside of the cover, and having a bar magnet fixed to it: consequently, as the bar magnet is rotated, it causes the shaft to rotate, and the shaft is non-rotationally connected to the floating stirrer, so as to rotate it, the guide rod in this instance, also, permitting the floating stirrer to move along it, with changes in liquid level.

Another aspect of the present invention is the construction of the floating stirrer, in one embodiment there being provided two buoyant elements of generally bar-bell shape, each having a magnet extending axially through it, two such bar-bell shaped buoyant elements being connected in side-by-side relationship with a guide tube extending between them, the guide tube having a reduced opening at its upper end, which is supported above the liquid level. In another embodiment of the floating stirrer, a pair of buoyant spheres are provided, held in laterally spaced relationship by upper and lower plates, a guide tube extending through the plates; the lower plate supports a pair of magnets.

Among the advantages of the present invention apparatus are the provision of a floating stirrer, enabling gentle stirring action to be achieved, with guidance of the stirrer so that its movement is restricted and it does not wander on the surface of the liquid, thereby eliminating the danger of dislocation of the stirrer and the possibility of crushing cells between the stirrer and the vessel walls, where culture medium is being stirred. Another advantage of the present invention is the avoidance of the possibility that the stirrer will be caused to strike the bottom of the vessel or flask, should the liquid level become low, and thereby the stirrer be drawn downwardly by a magnetic field generating apparatus located beneath the vessel, or that magnetic coupling will be lost, as where the magnetic field generator is located above the vessel. With the present apparatus, a magnetic field is provided which will be operative with the magnet within the vessel at any location of the magnet, as, in certain embodiments, the magnet changes its location with the change in location of the floating stirrer and the liquid level. The present apparatus also has the additional advantage that both vertical and lateral instability of the magnet within the vessel are avoided, through use of lateral magnetic field generating means and a guide rod for the stirrer, and there is the same magnetic force delivered to the magnet within the vessel, regardless of its position.

BRIEF DESCRIPTION OF THE DRAWINGS

FIG. 6 is a view similar to FIG. 3, of an alternate embodiment of a floating magnetic stirrer.

FIG. 7 is an elevational view of the floating magnetic stirrer of FIG. 6.

FIG. 8 is a cross-sectional view taken on the line 8—8 of FIG. 7.

FIG. 9 is an elevational view, with parts in section, of the second embodiment of a magnetic stirrer apparatus in accordance with the present invention.

FIG. 10 is a cross-sectional view taken on the line 10—10 of FIG. 9.

FIG. 15 is an elevational view, with parts in section and partly broken away, of another embodiment of a magnetic stirrer apparatus in accordance with the present invention.

FIG. 16 is a cross-sectional view taken on the line 16—16 of FIG. 15.

MODES FOR CARRYING OUT THE INVENTION

Figure 1:
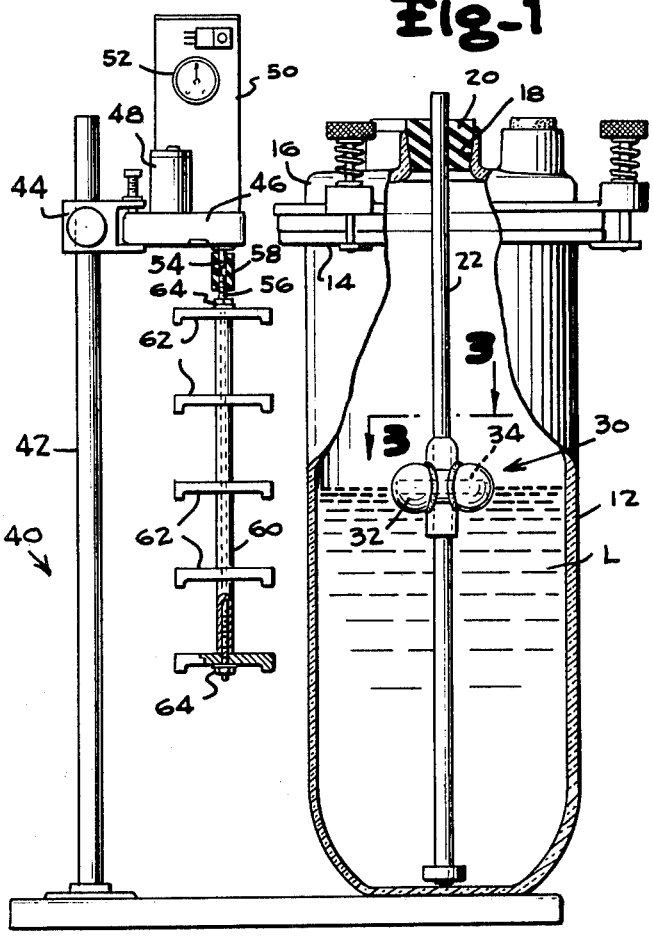
FIG. 1 is an elevational view, with parts in section, of a first embodiment of a magnetic stirrer apparatus in accordance with the present invention.

Referring now to the drawings, wherein like or corresponding reference numerals are used to designate like or corresponding parts throughout several views, there is shown in FIG. 1 a magnetic stirrer apparatus 10 comprising a vessel 12 having an open upper end 14 provided with a closure 16. The closure 16 may have an opening 18 in it, with a stopper 20 therein, and a guide rod 22 passes through and is supported by the stopper 20. Preferably, guide rod 22 is coaxial with the vessel 12. Although the vessel 12 is disclosed as a conventional flask used for culture medium, it may have a different configuration, and, specifically, may be a flask made in accordance with Pearson U.S. Pat. No. 4,382,685, issued May 10, 1983.

Within the vessel 12 there is provided a body of liquid L, and in accordance with normal practices, the volume of liquid L within the vessel 12 may change, thereby changing the elevation of the liquid level, or the surface of the body of liquid L. Floating on the body of liquid L is a floating stirrer, generally designated 30, including a buoyant element 32 having a magnet 34 therein.

Adjacent vessel 12 is a support apparatus 40 including an upstanding post 42 having an adjustable clamp 44 supporting a housing 46 in which are located reduction gears, there being provided on the housing 46 an electric motor 48. A control panel 50 mounted on the housing 40 contains control circuitry, and a potentiometer 52 for controlling the speed of motor 48. An output shaft 54 of the housing 56 is connected to a shaft 56 by a coupling 58. On shaft 56 are a plurality of spacer sleeves 60, between which are located magnets 62, the shaft 56 extending through each of the magnets 62 intermediate the ends thereof, and nuts 64 serve to lock the shaft 56, spacer sleeves 60 and magnets 62 against relative rotation. The length of the shaft 56 and the number of magnets 62 carried thereon is illustrative, the length and the number of magnets being determined so as to provide a rotating magnetic field for the full range of movement of the surface of the body of liquid L which is anticipated with a particular cell culture growth operation. Thus, the vertical array of magnets 62 is such as to provide a rotating magnetic field throughout the entire range and movement of the floating stirrer 30 with the magnet 34 within it.

Figure 2:
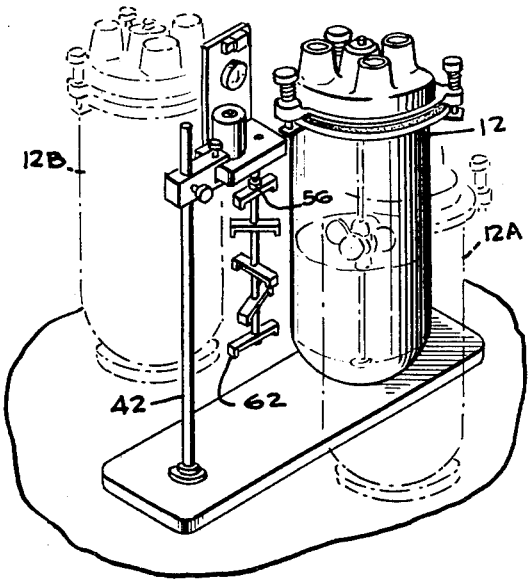
FIG. 2 is a perspective view of the magnetic stirrer apparatus of FIG. 1, with additional vessels, in perspective.

In FIG. 2, there is disclosed not only the vessel 12 shown in FIG. 1, but additional, substantially identical vessels 12A and 12B, positioned about the shaft 56. The vessels 12A and 12B will contain guide rods 22 and floating stirrers 30, and the rotating magnetic field generated by the magnets 62 will be in operative relationship with the magnets 34 contained in each of the vessels 12A and 12B. The positioning of the additional vessels 12A and 12B is illustrative, since such additional vessels may be placed in position within the rotating magnetic field generated by the rotating magnets 62 so as to cause the floating stirrers 30 therein to be rotated.

Figure 3:
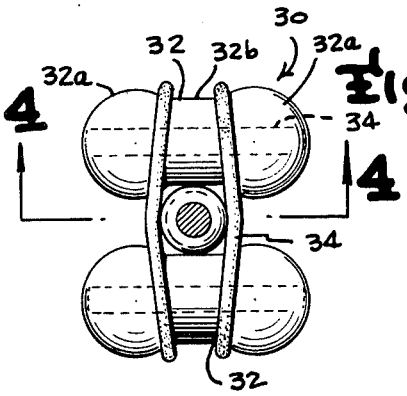
FIG. 3 is a cross-sectional view taken on the line 3—3 of FIG. 1.
Figure 5:
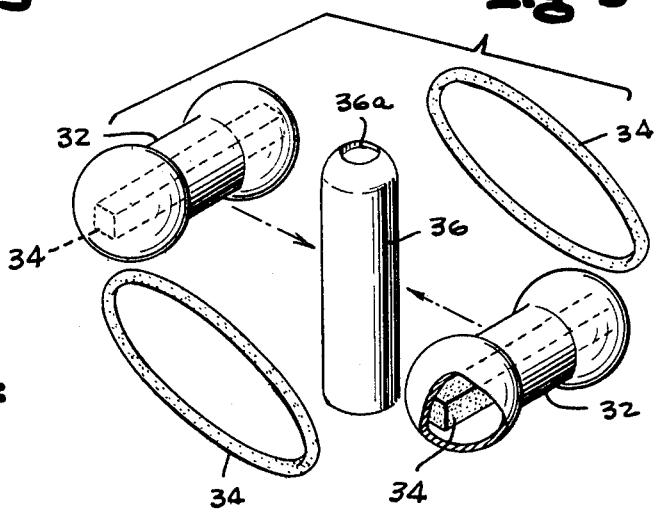
FIG. 5 is an exploded view of the floating magnetic stirrer shown in FIGS. 3 and 4.

In FIG. 3, there is disclosed the construction of the floating stirrer 30, there being shown a buoyant element 32 of generally bar-bell shape, having spherical end portions 32*a*, connected by a straight connecting portion 32*b*, the magnet 34 being a bar magnet and extending through the connecting portion 32*b*, and into the end portions 32*a*. Two substantially identical buoyant or floating stirrer elements 32 are provided, being held in laterally spaced relationship by elastic bands 34. Referring to FIG. 5, there may be seen the two elastic bands 34, the two buoyant elements 32 with bar magnets 34 therein, and there is also shown a guide tube 36, of generally hollow, cylindrical configuration and being narrow at its upper end with a reduced opening 36*a*. Opening 36*a* is the smallest diameter portion of guide tube 36. The elastic bands 34 connect the buoyant elements 32 to each other, in an assemblage with the guide tube 36, the bands 34 being located on the connecting portions 32*b* where they engage the end portions 32*a*, and cause the buoyant elements 32 to clamp the guide tube 36 between them.

Figure 4:
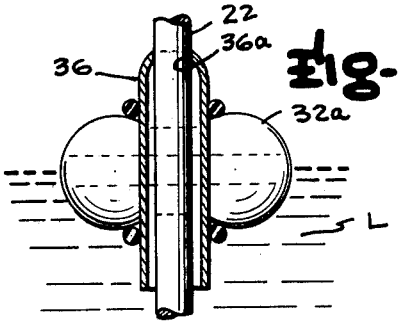
FIG. 4 is a cross-sectional view taken on the line 4—4 of FIG. 3.

In FIG. 4, the guide tube 36 is shown, with the guide rod 22 extending through it, the upper opening 36*a* of guide tube 36 being above the surface of the body of liquid L, and being that portion of guide tube 36 which has a guiding and moving relationship with the guide rod 22.

Referring to FIGS. 6–8, an alternate embodiment of a floating stirrer is provided, there being shown in FIG. 7 a floating stirrer 70 having a pair of spherical buoyant elements 72 held in spaced apart relationship by an upper plate 74*a* and a lower plate 74*b*, suitable threaded fasteners 76 securing the plates and buoyant elements together. The upper plate 74*a*, as shown in FIG. 6, has a relatively small opening 74*c* therethrough, and as shown in FIG. 8 the lower plate 74*b* has a relatively larger opening 74*d* therethrough. The guide rod 22 extends through the openings 74*c* and 74*d*, and thus through the floating stirrer 72, the guide rod 22 engaging, in sliding fashion, the opening 74*c* in the upper plate 74*a*. The lower plate 74*b* carries a pair of bar magnets 78.

In operation, with the flask 12 partially filled with liquid L, the floating stirrer 30 will float on the liquid body L, due to the buoyancy of the entire stirrer, provided principally by the buoyant elements 32. The floating stirrer 30 may move up and down, guided by the guide rod 22. The shaft 56 is caused to rotate by motor 48, and thereby rotates the vertical array of magnets 62, causing the generation of a rotating magnetic field which has cooperative engagement with the magnets 34 carried by the buoyant elements 32 of the floating stirrer 30. The rotating magnetic field thus generated causes the floating stirrer 30 to rotate. Its movement is restricted to rotation, generally about the axis of guide rod 32, and to movement along guide rod 32, when there are changes in the level of the liquid surface of the body of liquid L. Where plural vessels 12 are utilized, as in FIG. 2, all of the stirrers 30 will be rotated, as above set forth. In both the embodiment of the stirrer 30 as shown in FIGS. 3–5, and the embodiment of stirrer 70 shown in FIGS. 6–8, there is an upper opening which has cooperative engagement with the guide rod 22, so that liquid is not enabled to enter into the space between the bearing surfaces provided by the opening 36*a* of guide tube 36, or the opening 74*c* of plate 74*a*, and the guide tube 22. Thus, both danger of sticking of the stirrer and crushing of cells are avoided.

In FIG. 9, there is disclosed a stirrer 12, substantially identical to the stirrer 12 of FIG. 1. The laterally positioned moving magnetic field generator is provided by a core 80*a* having a coil 82*a* thereon, and connected to a suitable source of electricity. As shown in FIG. 10, there is a T-shaped support 84 comprising a cross bar 84*a* and a stem bar 84*b*, the latter having an opening 84*c* therein to receive a post 86. FIG. 10 discloses the arrangement, which includes the core 80*a* and coil 82*a*, the core 80*a* being connected to the cross bar 84*a* adjacent one end by a suitable bolt 86*a*, there being a similar core 80*b* secured adjacent the opposite end of the cross bar 84*a* by a bolt 86*b*. The core 80*b* has a coil 82*b* thereon. Thus, when either of the coils is energized, a magnetic field is generated, which collapses when the coil is de-energized, in known manner. The cores 80*a* and 80*b* extend along the vessel 12, generally parallel to its axis, and are in spaced relationship to each other.

Figure 11:
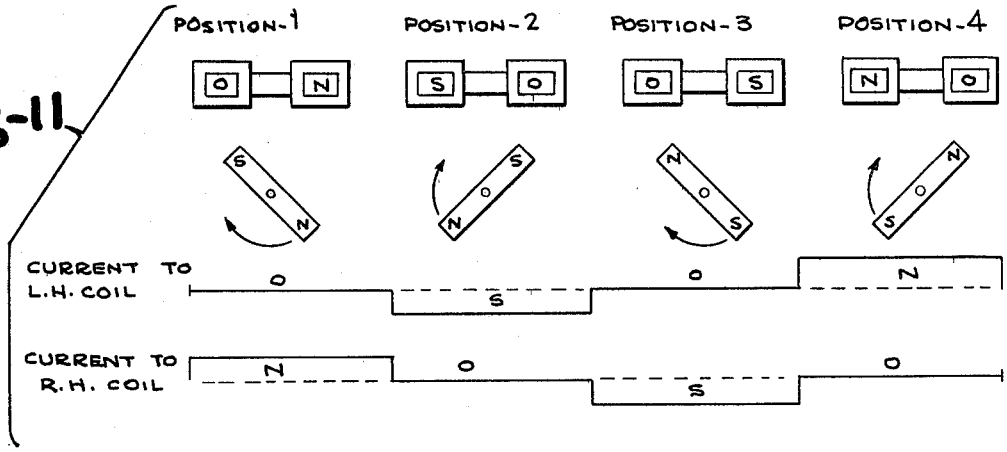
FIG. 11 is a diagram illustrating the action of the magnetic stirrer apparatus as shown in FIGS. 9 and 10.

As shown in FIG. 11, in Position 1, when positive current is supplied to coil 82*a*, which may be designated as the left hand coil, it acts as a "north" pole, the right hand coil not being energized, so that the north pole of the magnets 34 are repelled from the left hand coil, causing rotational movement of the magnet and the stirrer 30. In Position 2, the left hand coil has negative current supplied, causing it to act as a south pole, to attract the north pole of the magnet. In Position 3, the right hand coil is supplied with negative current, thereby repelling the south pole of the magnet and attracting the north pole of the magnet, while in Position 4, the left hand coil is energized positive, causing it to function as a north pole, attracting the south pole of the magnet.

The apparatus disclosed in FIGS. 9 and 10 operates in substantially the same manner as the apparatus of FIGS. 1 and 2. The moving magnetic field generated by the coils and core cause the magnets and the stirrer to rotate. The stirrer is guided, just as described in connection with the stirrer of FIG. 1. Further, the vertical extent of the cores is chosen to be substantially coextensive with the anticipated range of levels of the surface of the liquid L in the vessel 12. As will be understood, such construction is provided so that there will be a moving magnetic field operatively coupled with the magnets 34 in any position of the stirrer 30 as it changes position with the change in the surface of the liquid L.

While there has been disclosed a construction including a pair of coils, each provided with a core, it will be understood that the number of cores and coils may be increased above the two cores and coils which are shown for illustrative purposes in the drawing. Obviously, the supporting structure for a greater number of cores and coils would be modified, as necessary, and, further, it is contemplated that more than a single vessel 12 may be provided in position to have the stirrer thereof driven by the core and coil arrangement as herein disclosed.

Figure 12:
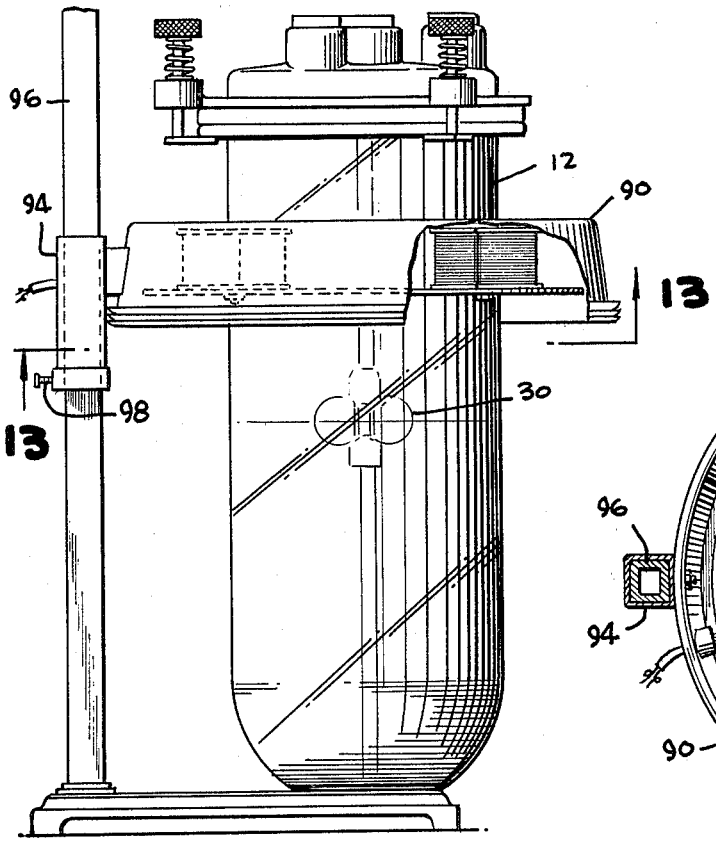
FIG. 12 is an elevational view, with parts in section, of a third embodiment of a magnetic stirrer apparatus in accordance with the present invention.
Figure 14:
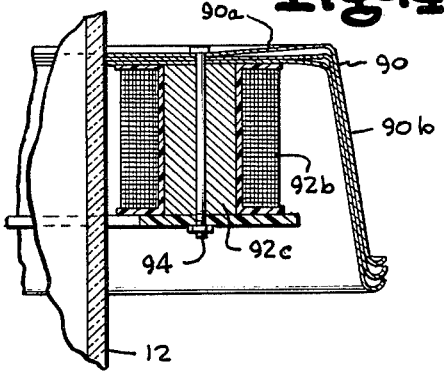
FIG. 14 is a cross-sectional view taken on the line 14—14 of FIG. 13.

In FIG. 12, there is disclosed a further embodiment of the present invention, including a vessel 12 which may be of the form shown in FIG. 1, as illustrated, or as are all of the vessels herein disclosed, may be of the construction as disclosed in the above-noted Pearson U.S. Pat. No. 4,382,685. In the apparatus of FIG. 12, an annular support 90 is provided, having within it a plurality of coils, such as the coils 92*a*–92*d*. The support 90 has connected to it a sleeve 94, which is carried on a post 96, having a turn screw 98, so as to enable the support 90 and the cores 92*a*–92*d* carried by it to be vertically adjusted at will. In FIG. 14, the coil 92*b* is shown, having a core 92*c*, such coils and core being of known construction, the support 90 having an upper wall 90*a* and a side wall 90*b*, with a bolt 94 serving to connect the coil 92*b* to the housing 90. The vessel 12 may be seen, with the coil 92*b* laterally thereof.

Figure 13:
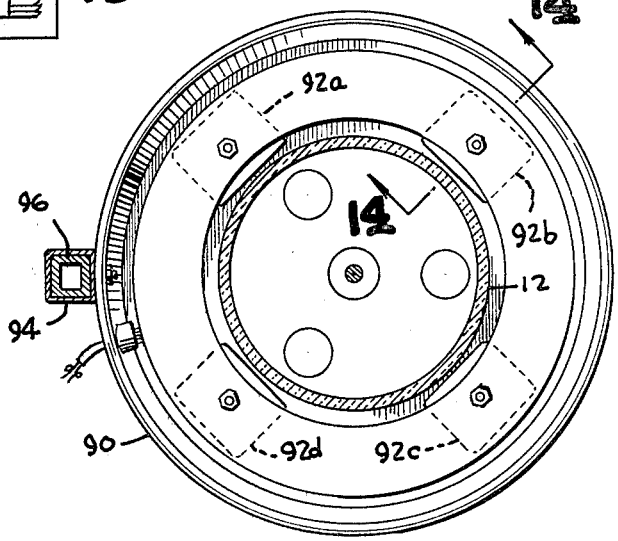
FIG. 13 is a cross-sectional view taken on the line 13—13 of FIG. 12.

In the apparatus of FIGS. 12–14, the support 90 will be adjusted, from time to time, for the desired position relative to the float 30, so as to achieve the desired magnetic force on the magnets of the floating stirrer. The speed of rotation of the floating stirrer 30 may be controlled by controlling the current supplied to the several coils 92, or by the relative position of the support 90 and coils 92 to the stirrer 30. Thus, the position of stirrer 30 shown in FIG. 12 relative to support 90 is to be taken as being for illustrative purposes only, and not as an indication of the necessary relative positioning as would be used in practice.

In FIG. 15, there is provided another embodiment of the present invention, in which there is a flask 12, the closure 16' therefor having on the underside thereof a bearing 102, schematically shown. A head 104 is provided, and rests upon and is supported by the bearing 102. Extending downwardly from the head 104 is a driving guide rod 106, which is of non-circular cross section. Fixedly mounted on the driving guide rod 106 is a bar magnet 108. A floating stirrer 110 is supported by the body of liquid L at its surface, and as shown in FIG. 16, the floating stirrer 110 is of generally elongate shape, having a non-circular opening 112 therein. More specifically, the driving guide rod 106 is of square transverse cross section, and the opening 112 in the floating stirrer 110 is of the same square cross section, the shapes thereby being congruent.

Laterally of the vessel 12 there is provided a coil 82*a* with a core 80*a'* which extends through the coil 82*a*; that is, it does not extend downwardly along the vessel, as does the core 80*a* (and core 80*b*) as in the embodiment of FIGS. 9 and 10. As will be understood, there is a second core and coil, carried by the T-shape support 84, on a post 86. Thus, the core and coil apparatus of FIG. 15 differ from that shown in FIGS. 9 and 10 by the shorter length of the cores. The magnetic field generated is a rotating magnetic field, and will be operatively coupled with the bar magnet 108, which does not move vertically.

Thus, in operation, the moving magnetic field generated by the core 80*a'*, the coil 82*a* and one or more additional cores and coils will cause the magnet 108 to rotate. Since the magnet 108 is secured to the driving guide rod 106, it will rotate the latter, the head 104 thereof being supported by the bearing 102. Due to the non-rotational coupling between the driving guide rod 106 and the floating stirrer 110, the latter will be rotated. Its movement will be restricted, however, in the same manner as the movement of the stirrer 30, being able to rotate and to move along the driving guide rod 106, but not being able to wander on the surface of the body of liquid L.

There has been provided an improved magnetic stirrer apparatus, particularly for stirring liquid cell culture medium, in a gentle and effective manner. The laterally positioned moving magnetic field generating means causes rotation of the floating stirrer, and the floating stirrer is guided, its movement being restricted to a rotational movement and to a movement along a guide rod. The provision of a laterally positioned rotating magnetic field generator and a floating, magnetically driven and guided stirrer avoids lateral and vertical instabilities found in prior art devices, while providing effective coupling between the driven magnet and the driving magnetic field, in any position in which the magnet will occupy, even where, as in certain embodiments, the magnet is associated with the floating stirrer and moves with it.

It will be obvious to those skilled in the art that various changes may be made without departing from the spirit of the invention, and therefore the invention is not limited to what is shown in the drawings and described in the specification but only as indicated in the appended claims.

I claim:

1. A magnetic stirrer apparatus comprising:

(a) a vessel having an opening at the upper part thereof, (b) a closure for said opening, (c) floating stirrer means in said vessel for stirring liquid in said vessel, (d) magnetic means for causing rotation of said floating stirrer means comprising:

(i) means laterally of said vessel for generating a moving magnetic field, and (ii) a magnet in said vessel drivingly connected to said stirrer means, and (e) guide means for restricting movement of said floating stirrer means to rotary movement and to substantially vertical movement with change in the liquid level in said vessel.

2. The magnetic stirrer apparatus of claim 1, said guide means comprising a guide rod extending substantially axially of said vessel, said floating stirrer means having an opening therethrough, said guide rod extending through said opening.

3. The magnetic stirrer apparatus of claim 2, said floating stirrer means comprising a tubular element surrounding said guide rod and receiving said guide rod therethrough, said tubular element having its upper end above the liquid level, said upper end being narrower than the remainder of said tubular element.

4. The magnetic stirrer apparatus of claim 1, wherein said means for generating a moving magnetic field comprises a shaft adjacent said vessel, means for rotating said shaft, and a magnet on said shaft, rotatable therewith.

5. The magnetic stirrer apparatus of claim 4, there being a plurality of magnets positioned axially along said shaft.

6. The magnetic stirrer apparatus of claim 5, said magnets extending from adjacent the upper part of said vessel to adjacent the lower part thereof.

7. The magnetic stirrer apparatus of claim 5, said magnets being bar magnets, and each said magnet on said shaft at a position between the ends of said magnet.

8. The magnetic stirrer apparatus of claim 1, wherein said means for generating a moving magnetic field comprises plural, laterally spaced cores extending along said vessel, and a coil on each said core adapted to be connected to a source of electricity.

9. The magnetic stirrer apparatus of claim 8, wherein said cores are substantially parallel to the axis of said vessel.

10. The magnetic stirrer apparatus of claim 9, said cores extending from adjacent the uppermost liquid level anticipated to the lower most liquid level anticipated.

11. The magnetic stirrer apparatus of claim 1, said magnetic field generating means comprising a plurality of coils, means for supporting said coils in spaced relationship about said vessel, and means for adjustably positioning said support and coils along said vessel.

12. The magnetic stirrer apparatus of claim 11, wherein said coils are supported in an annular array around said vessel.

13. The magnetic stirrer apparatus of claim 12, said support comprising an annular support element for said coils.

14. The magnetic stirrer apparatus of claim 13, wherein said means for adjustably positioning said support and coils comprises a standard adjacent said vessel, and means releasably connecting said support to said standard.

15. The magnetic stirrer apparatus of claim 1, wherein said magnet in said vessel is carried by said floating stirrer means, said magnetic field generating means comprising means for generating a moving magnetic field operatively related to said magnet at any liquid level of the liquid in said vessel.

16. The magnetic stirrer apparatus of claim 1, wherein said guide means comprises a rod, said magnet being secured to said rod, and means for coupling said rod and floating stirrer means for relative axial, non-rotational movement.

17. The magnetic stirrer apparatus of claim 16, wherein said coupling means comprises said rod being of non-circular configuration, said rod passing through a congruent opening in said floating stirrer means.

18. The magnetic stirrer apparatus of claim 1, said floating stirrer means comprising a buoyant element, a magnet supported by said buoyant element, and a guide tube, said guide means comprising a guide rod extending in said vessel and through said guide tube.

19. The magnetic stirrer apparatus of claim 18, said guide tube having an upper end and a lower end, said upper end being supported by said buoyant element above the liquid level, and having an opening relatively small in comparison with the remainder of said guide tube.

20. The magnetic stirrer apparatus of claim 1, said floating stirrer means comprising a pair of buoyant elements, each said buoyant element having a magnet therein, means for securing said buoyant elements in side-by-side, spaced relationship, a guide tube between said buoyant elements, and said guide means comprising a guide rod extending in said vessel and through said guide tube.

21. The magnetic stirrer apparatus of claim 20, wherein each of said buoyant elements comprises a pair of enlarged, generally spherical end portions, and a connecting portion between said end portions, said magnet extending axially through said connecting portion.

22. The magnetic stirrer apparatus of claim 1, wherein said floating stirrer comprises a pair of spherical buoyant elements, plate means connecting said spherical buoyant elements in laterally spaced relationship, a guide tube extending through said plate means, said magnet being carried by said plate means, and said guide means comprising a guide rod extending through said guide tube.

23. The magnetic stirrer apparatus of claim 22, said plate means comprising a first plate above said spherical buoyant elements, and a second plate below said spherical buoyant elements, said lower plate having a pair of magnets thereon.

24. A magnetic stirrer apparatus comprising:

(a) a vessel adapted to have a liquid therein subject to change in volume and the liquid level thereof, (b) a floating stirrer in said vessel adapted to rise and fall with changes in the liquid level in said vessel, (c) a magnet in said vessel, (d) means for rotating said magnet in said vessel comprising means laterally of said vessel for generating a moving magnetic field operatively related to said magnet, (e) means for drivingly connecting said magnet and said stirrer means for rotation of said stirrer means in said vessel, and (f) means for restricting movement of said floating stirrer means to rotational movement and to movement with the liquid level as the liquid level in said vessel changes.

25. The magnetic stirrer apparatus of claim 24, said last mentioned means comprising a guide rod in said vessel, an opening in said floating magnetic stirrer, said guide rod passing through said opening.

26. The magnetic stirrer apparatus of claim 25, said magnetic field generating means comprising a shaft parallel to said vessel, and a plurality of bar magnets fixed in axially spaced relation along said shaft.

27. The magnetic stirrer apparatus of claim 25, said magnetic field generating means comprising a plurality of cores extending along said vessel, and a coil on each said core adapted to be connected to a source of alternating current.

28. The magnetic stirrer apparatus of claim 25, said magnetic field generating means comprising a plurality of coils, means for supporting said coils laterally of and about said vessel, and means for adjusting the position of said supporting coils along said vessel.

29. The magnetic stirrer apparatus of claim 25, said guide rod being of non-circular cross section, said opening in said floating magnetic stirrer being congruent with said guide rod, said magnet being fixed on said guide rod, said guide rod comprising said means for drivingly connecting said magnet and said stirrer means.

* * * * *